US005414181A

United States Patent [19]

Bearden, Jr. et al.

[11] Patent Number: 5,414,181

[45] Date of Patent: May 9, 1995

[54] INTEGRATED CATALYTIC CRACKING AND OLEFIN PRODUCING PROCESS

[75] Inventors: Roby Bearden, Jr.; Michael C. Kerby; Stephen M. Davis, all of Baton Rouge, La.

[73] Assignee: Exxon Research and Engineering Company, Florham Park, N.J.

[21] Appl. No.: 154,832

[22] Filed: Nov. 19, 1993

[51] Int. Cl.[6] ..... C07C 5/32; C07C 5/333; C01G 11/05

[52] U.S. Cl. ..... 585/654; 585/658; 585/379; 208/120

[58] Field of Search ..... 585/654, 660, 661, 662, 585/435, 379, 658; 208/113, 50, 53, 8 R, 80, 120

[56] References Cited

U.S. PATENT DOCUMENTS 2,269,696 9/1981 Metrailer ..... 208/120
4,447,665 5/1984 Wennerberg ..... 585/379

*Primary Examiner*—Asok Pal
*Assistant Examiner*—Bekir L. Yildirim
*Attorney, Agent, or Firm*—Richard D. Jordan

[57] ABSTRACT

Disclosed is a method which combines catalytic cracking and olefin production using a coked catalytic cracking catalyst to dehydrogenate an alkane feed stream and form an olefin rich product stream. Preferably, the coked catalytic cracking catalyst has a carbon content of about 0.2–10 wt. %. The catalyst preferably comprises a crystalline tetrahedral framework oxide component.

6 Claims, 1 Drawing Sheet

INTEGRATED CATALYTIC CRACKING AND OLEFIN PRODUCING PROCESS

FIELD OF THE INVENTION

This invention relates to a catalytic cracking and olefin producing process. More particularly, this invention relates to a method which combines catalytic cracking and olefin production using a coked catalytic cracking catalyst to dehydrogenate an alkane feed stream and form an olefin rich product stream.

BACKGROUND OF THE INVENTION

The emergence of low emissions fuels has created a need to increase the availability of olefins for use in alkylation, oligomerization, MTBE and ETBE synthesis. In addition, a low cost supply of olefins continues to be in demand to serve as feedstock for polyolefin production.

Fixed bed processes for light paraffin dehydrogenation have recently attracted renewed interest for increasing olefin production. However, these type of processes typically require a high capital investment as well as a high operating cost. It is, therefore, advantageous to increase olefin yield using processes which require only a minimal amount of capital investment. It would be particularly advantageous to increase olefin yield in catalytic cracking processes.

U.S. Pat. No. 4,830,728 discloses a fluid catalytic cracking (FCC) unit which is operated to maximize olefin production. The FCC unit has two separate risers in which different feed streams are introduced. The operation of the risers is designed so that a certain catalyst will act to convert a heavy gas oil in one riser and a different catalyst will act to crack a lighter olefin/-naphtha feed in the other riser. Conditions within the heavy gas oil riser are modified to maximize either gasoline or olefin production. The primary means of maximizing production of the desired product is by using a specified catalyst.

A problem inherent in producing olefin products using FCC units is that the process depends upon a specific catalyst balance to maximize production. In addition, even if a specific catalyst balance can be maintained to maximize overall olefin production, olefin selectivity is generally low due to undesirable side reactions such as extensive cracking, isomerization, aromatization and hydrogen transfer reactions. It is, therefore, desirable that olefin production be maximized in a process which allows a high degree of control over olefin selectivity.

SUMMARY OF THE INVENTION

In order to overcome problems inherent in the prior art, the present invention provides an integrated catalytic cracking and alkane dehydrogenation process which comprises catalytically cracking a petroleum hydrocarbon with a catalytic cracking catalyst to form a coked catalytic cracking catalyst and cracked hydrocarbon product; regenerating the coked catalytic cracking catalyst to form a regenerated catalytic cracking catalyst; depositing coke onto the regenerated catalytic cracking catalyst to form a dehydrogenation catalyst; and dehydrogenating a $C_2$–$C_{10}$ alkane feed stream with the dehydrogenation catalyst.

In a preferred embodiment, the catalytic cracking catalyst comprises a zeolite crystalline framework oxide. In the preferred embodiment, the alkane feed stream comprises at least one component selected from the group consisting of ethane, propane, butane, pentane, hexane, heptane, octane, nonane, decane, isobutane, isopentanes, isohexanes, isoheptanes and isooctanes.

In another preferred embodiment, the coke is deposited onto the regenerated catalytic cracking catalyst by adding a coke precursor to the regenerated catalytic cracking catalyst. The coke is preferably deposited onto the regenerated catalytic cracking catalyst to obtain a dehydrogenation catalyst which comprises about 0.2–10 wt % carbon.

In yet another preferred embodiment, the alkane feed stream is dehydrogenated to an olefin product stream which comprises at least 1 wt % total olefin. Preferably, the alkane feed stream is dehydrogenated with the dehydrogenation catalyst in a reactor having an alkane vapor residence time of about 0.5–60 seconds.

BRIEF DESCRIPTION OF THE DRAWING

The present invention will be better understood by reference to the Detailed Description of the Invention when taken together with the attached drawing, wherein.

DETAILED DESCRIPTION OF THE INVENTION

Figure 1:
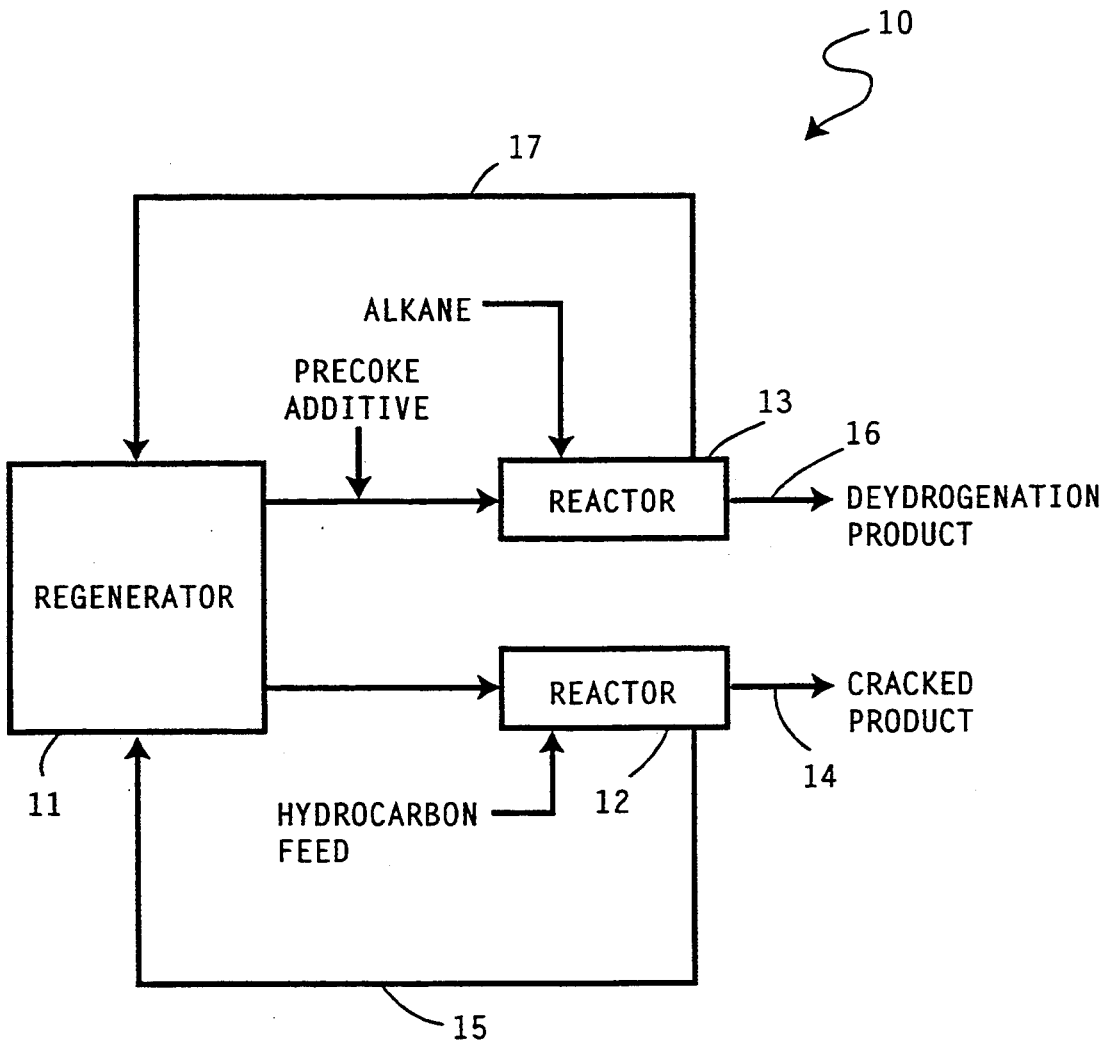
FIG. 1 is a shematic representation of a preferred embodiment of the invention.

Catalytic cracking is a process which is well known in the art of petroleum refining and generally refers to converting a large hydrocarbon molecule to a smaller hydrocarbon molecule by breaking at least one carbon to carbon bond. For example, large paraffin molecules can be cracked to a paraffin and an olefin, and a large olefin molecule can be cracked to two or more smaller olefin molecules. Long side chain molecules which may be present on aromatic rings or naphthenic rings can also be cracked.

It has been found that a coked catalytic cracking catalyst can be used to enhance the dehydrogenation of an alkane feed stream to produce an olefin stream. By using a coked catalytic cracking catalyst as the catalyst for the dehydrogenation reaction, this aspect of the invention can be integrated into the catalytic cracking process to increase olefin yield in the overall reaction scheme. This increased olefin yield is advantageous since the olefin product can be used as a feedstock in other reaction processes to either increase the octane pool in a refinery, or the olefins can be used in the manufacture of gasoline additives which are required to reduce undesirable hydrocarbon emissions. In addition, the process of this invention allows for high olefin selectivity such that a portion of the olefin stream can also be used in other chemicals processes such as polyolefin production.

In the catalytic cracking step of this invention, the hydrocarbon feed is preferably a petroleum hydrocarbon. The hydrocarbon is preferably a distillate fraction having an initial ASTM boiling range of about 400° F. Such hydrocarbon fractions include gas oils, thermal oils, residual oils, cycle stocks, topped whole crudes, tar sand oils, shale oils, synthetic fuels, heavy hydrocarbon fractions derived from the destructive hydrogenation of coal, tar, pitches, asphalts, and hydrotreated feed stocks derived from any of the foregoing.

The hydrocarbon feed is preferably introduced into a riser which feeds a catalytic cracking reactor vessel. Preferably, the feed is mixed in the riser with catalytic cracking catalyst that is continuously recycled.

The hydrocarbon feed can be mixed with steam or an inert type of gas at such conditions so as to form a highly atomized stream of a vaporous hydrocarbon-catalyst suspension. Preferably, this suspension flows through the riser into the reactor vessel. The reactor vessel is preferably operated at a temperature of about 800°–1200° F. and a pressure of about 0–100 psig.

The catalytic cracking reaction is essentially quenched by separating the catalyst from the vapor. The separated vapor comprises the cracked hydrocarbon product, and the separated catalyst comprises a carbonaceous material (i.e., coke) as a result of the catalytic cracking reaction.

The coked catalyst is preferably recycled to contact additional hydrocarbon feed after the coke material has been removed. Preferably, the coke is removed from the catalyst in a regenerator vessel by combusting the coke from the catalyst. Preferably, the coke is combusted at a temperature of about 900°–1400° F. and a pressure of about 0–100 psig. After the combustion step, the regenerated catalyst is recycled to the riser for contact with additional hydrocarbon feed.

The catalyst which is used in this invention can be any catalyst which is typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophophates (ALPOs) and tetrahedral silicoaluminophosphates (SAPOs). More preferably, the crystalline framework oxide component is a zeolite.

Zeolites which can be employed in accordance with this invention include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A, L, ZK-4, ZK-5, B, E, F, H, J, M, Q, T, W, Z, alpha and beta, ZSM-types and omega.

In general, aluminosilicate zeolites are effectively used in this invention. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst used in this invention can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM #D3907-8). Compounds such as those disclosed in Greensfelder, B. S., et al., *Industrial and Engineering Chemistry*, pp. 2573–83, Nov. 1949, are desirable. Alumina, silica-alumina and silica-alumina-zirconia compounds are preferred.

The inert catalyst framework component densifies, strengthens and acts as a protective thermal sink. The inert catalyst framework component used in this invention preferably has a cracking activity that is not significantly greater than the acceptable thermal blank. Kaolin and other clays as well as $\alpha$-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-$\gamma$-alumina, boehmite, diaspore, and transitional aluminas such as $\alpha$-alumina, $\beta$-alumina, $\gamma$-alumina, $\delta$-alumina, $\epsilon$-alumina, $\kappa$-alumina, and $\rho$-alumina can be employed. Preferably, the alumina species is an aluminum trihydroxide such as gibbsire, bayerite, nordstrandite, or doyelite.

According to this invention, in order to produce an olefin stream, an olefin reaction is commenced by contacting an alkane feed stream with a coked catalytic cracking catalyst. The alkane feed stream of this invention is preferably a $C_2$–$C_{10}$ alkane composition. The alkane composition can be either branched or unbranched. Such compositions include ethane, propane, butane, pentane, hexane, heptane, octane, nonane, decane, isobutane, isopentanes, isohexanes, isoheptanes and iso-octanes.

A coked catalytic cracking catalyst is a catalytic cracking catalyst as described above which contains a measurable content of carbonaceous material (i.e., coke) on the catalyst, and which will effectively enhance dehydrogenation of the alkane feed stream to selectively form an olefin product. Preferably, the carbon content of the coked catalytic cracking catalyst will be about 0.2–10 wt %, more preferably from about 0.3–5.0 wt. %, and most preferably about 0.4–2.5 wt. %.

A coked catalytic cracking catalyst can be obtained by any of numerous means. As one example, the coked catalytic cracking catalyst can be obtained as a result of a partial or incomplete regeneration of at least a portion of the spent catalyst stream in a FCC unit. One of ordinary skill in the art will be able to attain the desired concentration of coke on the catalytic cracking catalyst using well known means of adjusting temperature, oxygen content or burn time within the regenerator portion of the FCC unit.

In a preferred embodiment, fresh or fully regenerated catalytic cracking catalyst can be used by applying a precoking additive under dehydrogenation conditions. Preferably, the precoking additive is added to a catalytic cracking catalyst after the catalyst has been fully regenerated in the regenerator portion of the FCC unit. Materials which can be used as a precoking additive are compounds which effectively form carbonaceous deposits on the catalyst surface. Examples of these compounds include light olefins, light and heavy naphthas, petroleum residuum, refinery sludge, tank bottoms, gas oils, FCC cycle oils and bottoms, and torch oils.

The amount of precoking additive that will be used to coke the catalytic cracking catalyst will be highly dependent upon the amount of carbon material that may be present on the catalytic cracking catalyst. The more carbon material that is already on the catalytic cracking catalyst, the less that will be needed to coke the catalyst to the desired level. The initial coke content should, therefore, be measured to determine if a precoking additive is needed. Methods of determining coke content are well known to those of ordinary skill in the art. Once the initial coke content is determined, the corresponding amount of coke precursor is added to achieve the desired final coke content.

The conversion of alkane to olefin in this invention generally involves a dehydrogenation reaction. In the dehydrogenation reaction, alkanes are converted to olefins and molecular hydrogen. This reaction is highly endothermic. Preferably, the dehydrogenation reaction is carried out at a temperature of about 800°-1600° F., more preferably about 800°-1400° F.

The dehydrogenation reaction is somewhat dependent upon pressure. In general, the higher the pressure, the lower the conversion of alkane to olefin. Preferably, the process is carried out at about 0-100 psig.

The contact time between the alkane stream and the coked catalytic cracking catalyst will also affect the yield of olefin product. Typically, optimal contact between the coked catalyst and the alkane stream is attained when the olefin product stream contains a concentration of at least about 1 wt % total olefin. Preferably, alkane vapor residence time will range from about 0.5-60 seconds, more preferably, about 1.0-10 seconds.

A preferred embodiment of this invention is shown in FIG. 1 in which the dehydrogenation reaction is incorporated into a catalytic cracking process. The integrated catalytic cracking and alkane dehydrogenation process takes place generally in a FCC unit 10 which includes a regenerator 11, a cracking reactor 12 and a satellite reactor 13. The cracking reactor 12 comprises a main reactor vessel and can include a riser conduit where hydrocarbon feed is injected and initially contacts regenerated catalytic cracking catalyst from the regenerator 11. The catalytic cracking reaction is initiated as the hydrocarbon feed contacts the catalyst, and continues until the catalyst is separated from the hydrocarbon within the cracking reactor 12. Separation can be accomplished using any of the acceptable FCC separation devices such as cyclone separators. After separation, the cracked hydrocarbon product leaves the reactor 12 through product line 14, and the separated catalyst, which becomes coked (i.e., spent) in the cracking reaction, is returned to the regenerator 11 through a spent catalyst line 15.

In the regenerator 11, the coke is effectively removed from the catalyst according to well known regeneration procedures. The coke is effectively removed when the catalyst is sufficiently active to promote the hydrocarbon cracking reaction. Preferably, the regenerated catalyst will contain no more than about 0.5 wt % coke, more preferably the regenerated catalyst will contain no more than about 0.2 wt % coke.

The regenerated catalyst is recycled to the cracking reactor 12 where additional hydrocarbon feed is injected and cracked. In addition, a portion of the regenerated catalyst is sent to the satellite reactor 13. The satellite reactor 13 can be any type of reactor vessel that is operable under dehydrogenation conditions. For example, the satellite reactor 13 can be a transfer line riser reactor, a slumped bed reactor, a spouting bed reactor or a moving bed reactor. Preferably, the satellite reactor 13 will be capable of supporting a fluid bed catalyst at a density of about 1-45 lbs of catalyst per cubic foot of reactor volume.

As the regenerated catalyst is introduced to the satellite reactor 13, it is contacted with a precoking additive under dehydrogenation conditions to obtain a coked catalytic cracking catalyst. The coked catalytic cracking catalytic catalyst is then contacted with an alkane stream to commence the dehydrogenation reaction. The dehydrogenation reaction is effectively quenched by separating the dehydrogenated products from the catalyst. Separation can be accomplished using any of the acceptable FCC separation type devices such as cyclone separators. After separation, the dehydrogenation product leaves the satellite reactor 13 through dehydrogenation product line 16, and the separated catalyst, which becomes further coked in the dehydrogenation reaction, is returned to the regenerator 11 through a spent catalyst line 17.

The invention will be further understood by reference to the following Example, which includes a preferred embodiment of the invention.

EXAMPLE

An equilibrium zeolite beta FCC catalyst ($SiO_2$ 65.1 wt %; $Al_2O_3$ wt %; $Na_2O$ 0.28 wt %; $REO_2$ 2.14 wt %) was placed in a fixed bed quartz reactor. The temperature of the reactor was maintained at 1250° F., and the pressure was maintained at 0 psig. Six runs were made varying the carbon content on the catalyst from 0.2 wt % (no pretreatment) to 2.7 wt % (pretreatment with either heavy cat naphtha (HCN) or petroleum residuum (resid)). Iso-butane feed was passed through the reactor at 1 second residence time and GHSV of 1066. The results are shown in Table 1.

TABLE 1

| Run Number | 001 | 002 | 003 | 004 | 005 | 006 |
|---|---|---|---|---|---|---|
| Feed | none | HCN | HCN | Resid | Resid | Resid |
| Pre-Treat Cat/Oil | — | 5.1 | 3.0 | 4.8 | 3.0 | 1.8 |
| Pre-Treat Carbon Content (wt %) | 0.2 | 0.8 | 1.1 | 2.2 | 2.5 | 2.7 |
| Feed | i-$C_4H_{10}$ | i-$C_4H_{10}$ | i-$C_4H_{10}$ | i-$C_4H_{10}$ | i-$C_4H_{10}$ | i-$C_4H_{10}$ |
| Iso-$C_4H_{10}$ Conversion (wt %) | 45.3 | 37.8 | 39.4 | 33.1 | 34.3 | 36.0 |
| Selectivity (%) | | | | | | |
| $C_1$-$C_3$ | 55.1 | 43.8 | 41.7 | 35.0 | 35.6 | 36.2 |
| n-$C_4H_{10}$ | 3.0 | 0.3 | 2.2 | 1.8 | 1.8 | 2.0 |
| 1-$C_4H_8$ | 5.6 | 7.0 | 6.3 | 5.6 | 5.8 | 5.8 |
| t-2-$C_4H_8$ | 5.9 | 6.9 | 6.3 | 5.6 | 5.6 | 5.8 |
| c-2-$C_4H_8$ | 5.3 | 5.6 | 5.1 | 4.5 | 4.6 | 4.6 |
| Iso-$C_4H_8$ | 20.8 | 31.1 | 36.4 | 45.5 | 45.1 | 44.0 |
| >C4's | 4.4 | 5.5 | 2.1 | 1.4 | 1.5 | 1.6 |
| Iso-$C_4H_8$ | 9.4 | 11.7 | 14.3 | 15.0 | 15.5 | 15.8 |

TABLE 1-continued

| Run Number | 001 | 002 | 003 | 004 | 005 | 006 |
|---|---|---|---|---|---|---|
| Yield (wt %) | | | | | | |

Having now fully described this invention, it will be appreciated by those skilled in the art that the invention can be performed within a wide range of parameters within what is claimed.

What is claimed is:

1. An integrated catalytic cracking and alkane dehydrogenation process comprising:

contacting a petroleum hydrocarbon with a catalytic cracking catalyst containing a zeolite crystalline framework oxide to form a coked catalytic cracking catalyst and a cracked hydrocarbon product wherein the petroleum hydrocarbon and the catalytic cracking catalyst are contacted under catalytic cracking conditions;

regenerating the coked catalytic cracking catalyst under regeneration conditions to form a regenerated catalytic cracking catalyst;

depositing a measurable content of coke onto the regenerated catalytic cracking catalyst to form an effective dehydrogenation catalyst; and contacting under dehydrogenation conditions a $C_2$–$C_{10}$ alkane feed stream with the coke-deposited dehydrogenation catalyst to selectively form an olefin product.

2. The process of claim 1, wherein the alkane feed stream comprises at least one component selected from the group consisting of ethane, propane, butane, pentane, hexane, heptane, octane, nonane, decane, isobutane, isopentanes, isohexanes, isoheptanes and isooctanes.

3. The process of claim 1, wherein the coke is deposited onto the regenerated catalytic cracking catalyst by adding a coke precursor to the regenerated catalytic cracking catalyst.

4. The process of claim 1, wherein the coke is deposited onto the regenerated catalytic cracking catalyst to obtain a dehydrogenation catalyst which comprises about 0.2–10 wt % carbon.

5. The process of claim 1, wherein the alkane feed stream is dehydrogenated to an olefin product stream which comprises at least 1 wt % total olefin.

6. The process of claim 1, wherein the alkane feed stream is dehydrogenated with the dehydrogenation catalyst at an alkane vapor residence time of about 0.5–60 seconds.

* * * * *